US006836984B2

(12) United States Patent
Vanderheyden

(10) Patent No.: US 6,836,984 B2
(45) Date of Patent: Jan. 4, 2005

(54) DEVICE FOR IRONING LAUNDRY AND RESILIENT ELEMENT THEREFOR

(76) Inventor: Herman Vanderheyden, 1, Rue du Gabian, MC-98000 Monaco (MC)

( * ) Notice: Subject to any disclaimer, the term of this patent is extended or adjusted under 35 U.S.C. 154(b) by 0 days.

(21) Appl. No.: 10/169,567

(22) PCT Filed: Dec. 29, 2000

(86) PCT No.: PCT/EP00/13348

§ 371 (c)(1),
(2), (4) Date: Nov. 15, 2002

(87) PCT Pub. No.: WO01/49921

PCT Pub. Date: Jul. 12, 2001

(65) Prior Publication Data

US 2003/0093929 A1 May 22, 2003

(30) Foreign Application Priority Data

Jan. 3, 2000 (BE) ..... 2000/0001

(51) Int. Cl.[7] ..... D06F 83/00
(52) U.S. Cl. ..... 38/66
(58) Field of Search ..... 100/210, 211, 100/295, 297, FOR 103; 38/66, 140, 44, 45, 50, 51, 62

(56) References Cited

U.S. PATENT DOCUMENTS 1,432,940 A 10/1922 Yates
1,468,557 A * 9/1923 Cline ..... 38/63
1,990,648 A 2/1935 Herzog
2,190,146 A * 2/1940 Bristol ..... 38/66
2,439,530 A * 4/1948 Tea ..... 267/106
3,115,717 A 12/1963 Schmitz

FOREIGN PATENT DOCUMENTS

GB 298780 10/1927
GB 1518433 7/1978

* cited by examiner

*Primary Examiner*—Ismael Izaguirre
(74) *Attorney, Agent, or Firm*—Webb Ziesenheim Logsdon Orkin & Hanson, P.C.

(57) ABSTRACT

A device for ironing laundry, which device consists of a heated, semi-cylindrical bed and a roller arranged rotatably therein, the outer periphery of which lies some distance from the bed wall, wherein the roller periphery directed toward the bed is covered with a resiliently yielding layer of textile, wherein between the roller wall and the layer of textile are arranged resilient elements which are each formed by an elongate carrier with a number of parallel strip-like resilient members directed transversely thereof and held by the carrier at an angle relative to the roller wall, which carriers are held fixedly in axial direction on the roller wall, thereby ensuring a better resilience and a better attachment of the covering to the roller.

13 Claims, 2 Drawing Sheets

DEVICE FOR IRONING LAUNDRY AND RESILIENT ELEMENT THEREFOR

BACKGROUND OF THE INVENTION

1. Field of the Invention

The invention relates to a device for ironing laundry.

2. Description of the Prior Art

A number of embodiments are already known for arranging the layer of textile in resiliently yielding manner on the periphery of the roller. Ribbons with helical springs are used for this purpose, which helical springs are arranged on a strip-like carrier in a fully automatic operation, which carrier is wound as a spiral round the roller. A fabric or textile cloth, usually is flannel cloth, is then normally wound in two or more layers over the protruding springs. The yielding of the covering serves to hold the laundry firmly against the inner wall of the bed, so that a good ironing progression is ensured. In another embodiment the helical springs are replaced by resilient plates which are also wound helically round the roller on a carrier. The drawback of these known systems is that assembly is quite complicated because of the helical form, wherein the resilient tongues in the above stated second embodiment do not form a precisely closed cylindrical support surface for the textile layer. In addition, the springs can easily be damaged in the known systems when the covering is replaced.

To overcome some of the mentioned problems U.S. Pat. No. 1,432,940 proposed an element with a carrier and a plurality of spring members secured to the carrier with free ends which are overlapping in one direction. U.S. Pat. No. 298,780 proposes a similar element using circular curved leaf springs secured at their butts to a belt wrapped upon the roller. Both systems have the drawback that they do not form a precisely closed cylinder surface.

A third American patent, U.S. Pat. No. 3,115,717 describes a system which uses as well a plurality of elastic elements comprising each a first portion connected to a strip-like support, and a second portion which is rendered coplanar with the adjacent second portion by means of a recess in which the edge of the adjacent second portion extends. In that way the flatness of the support surface is improved. However, the surface still shows grooves where the edge extends in the recess.

Another spring module is known from Great Britain Patent No. 1,518,433. This module has a carrier which is provided with interlocking means for connecting the module with an adjacent module. This system simplifies the assembling of the modules, but again has the drawback of a non-continuous support surface when fitted on a roller.

SUMMARY OF THE INVENTION

The invention has for its object to obviate the above stated drawbacks and provides for this purpose a device which is distinguished in that the resilient member is engaged with the adjoining resilient members, such that a continuous practically cylindrical support face is obtained.

Owing to the fact that the elongate carrier runs parallel to the roller axis, these carriers can easily be adjusted to the length of the roller and ensure a much better resilience, so that it is possible to suffice with only one layer of textile on the resilient elements without the danger of the textile tearing.

According to a further development of the invention it is recommended to provide the carrier with attaching members for mutually attaching adjoining carriers in the assembled situation. Assembly can hereby be simplified considerably, because only the first row of carriers are mounted on the roller wall parallel to the rotation axis of the roller with a screw or rivet and the like, whereafter the leading carriers relative to the rotation direction of the roller are attached to the preceding carriers.

According to the invention each strip-like resilient member is further bent, the end part of which remote from the carrier extends at a distance from and practically parallel to the roller wall in the assembled situation and is provided with attaching means for the textile layer. A practically cylindrical support surface for the textile layer is obtained with this embodiment. Owing to the good attachment, the covering itself does not have to take a strong nature, since the friction forces are transferred directly via the resilient members onto the roller.

In order to further enhance this cylindrical support surface, it is recommended to provide each strip-like member close to the bend with an opening, and to embody it at the end part thereof with a tongue-shaped protrusion which in the assembled situation can be received in the opening of the adjoining resilient member. The resilient strip is hereby supported both on the free end remote from the roller and by the carrier, which prevent spreading of the resilient members and therefore improves a perfect continueous cylindrical support surface. Such a structure allows the use of a relatively thin covering placed in a single layer. The resilient members will moreover not be damaged when the covering is withdrawn for replacement.

In order to cause the resilience to develop more smoothly, it is recommended to decrease the width of the intermediate part of the strip-like resilient member located between carrier and end part by means of recesses. These recesses can lie on the side or in the middle part itself.

It is further recommended to form the carrier from a flat strip, wherein the attaching means according to the present invention consist of openings on the one hand and a hook-shaped protrusion resilient relative to the strip on the other, which protrusion can be guided in each case into the co-acting opening of the adjoining resilient member in the assembled situation.

The invention finally also relates to a resilient element suitable for a device as described above, wherein the carrier and the resilient members with associated attaching means are formed integrally from a punched strip of material such that the axially mounted carriers with the resilient members can be assembled as a jacket around the roller. It is recommend to use strips having different width; so obtaining different steps, e.g. a strip-profile of 20 mm and 19 mm. In this way the total length can easily be adapted to the circumference length of the drum. Further the strips may have a different height, such that a smooth overlap of the single covering layer can easily be formed.

BRIEF DESCRIPTION OF THE DRAWINGS

The invention is further elucidated in the figure description hereinbelow of an embodiment.

DETAILED DESCRIPTION OF THE PREFERRED EMBODIMENTS

Figure 1:
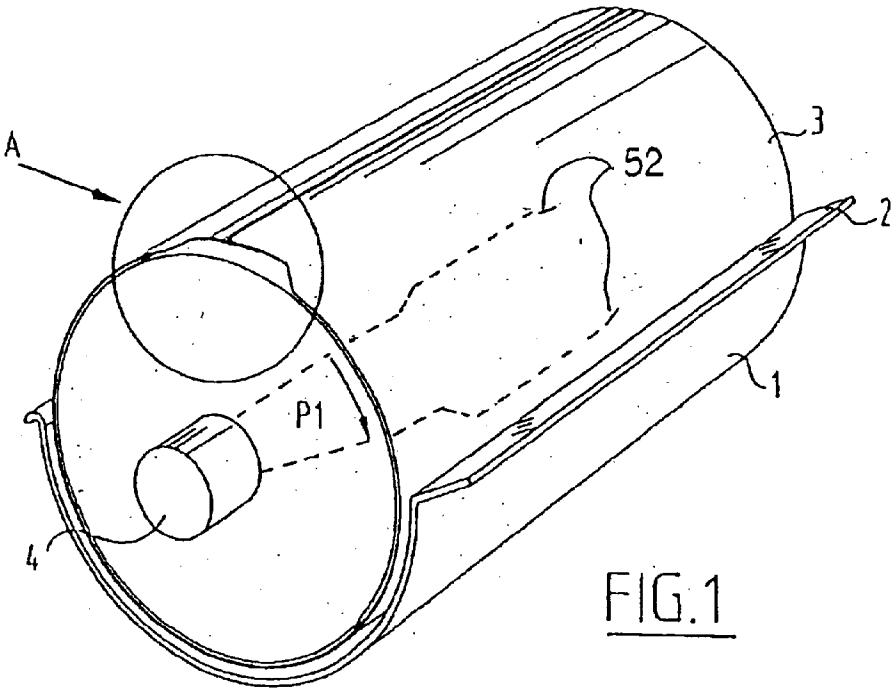
FIG. 1 is a perspective schematic view of an ironing device according to the invention provided with a schematically represented bed wall and a roller arranged rotatably therein.

Designated in FIG. 1 with the numeral 1 is the bed, of which only the inner wall is shown, and the support edge 2 with which the laundry (not shown) is guided to the roller 3. Roller 3 is supported in a housing (not shown) for rotation on bearings 4 and is rotated in the direction of arrow P1.

Figure 2:
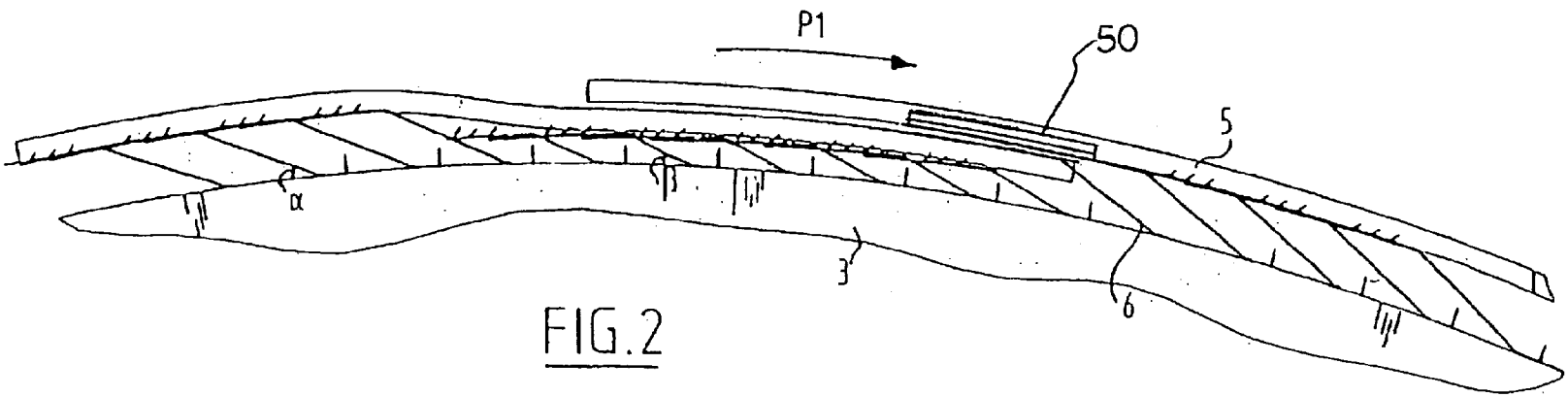
FIG. 2 is an axial view of a part of the roller wall having resilient elements and textile layer arranged thereon.

Defined between roller 3 and the inner wall of bed 1 is a space which is wholly or partially filled by a flexible layer of a textile layer on the outside which is supported resiliently, this being further elucidated hereinbelow. Textile layer 5 can be of any random type and is usually a flannel fabric or preferably needle felt which is per se already resilient, but which is further supported by resilient elements 6, see FIG. 2, so that textile layer 5 can be compressed in the direction of roller 3. Textile layer 5 is attached or hooked to the resilient elements and wrapped round the roller counter to the rotation direction P1, so that during rotation in the direction of arrow P1 the textile layer 5 winds itself tight due to the generated friction during rotation of the roller.

Figure 3:
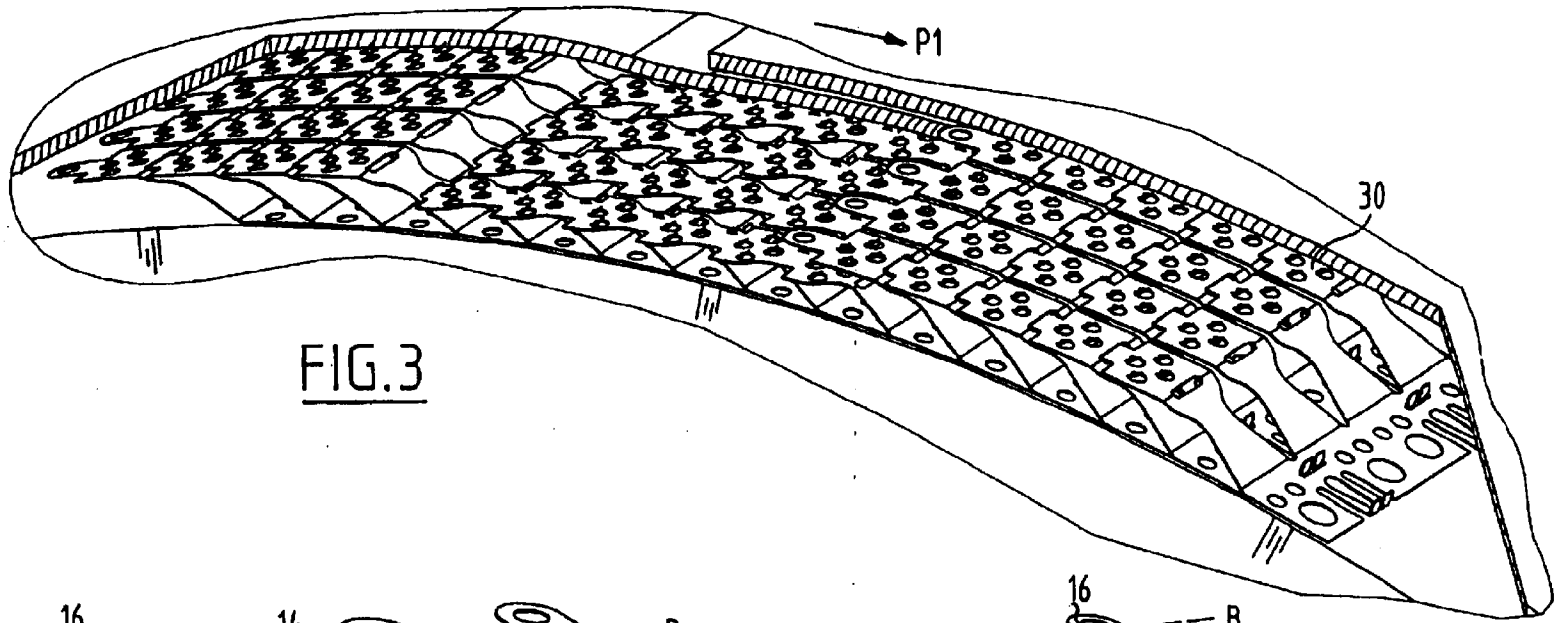
FIG. 3 is a perspective view of a detail of the roller wall along arrow A in FIG. 1, wherein the textile layer is broken away.
Figure 4:
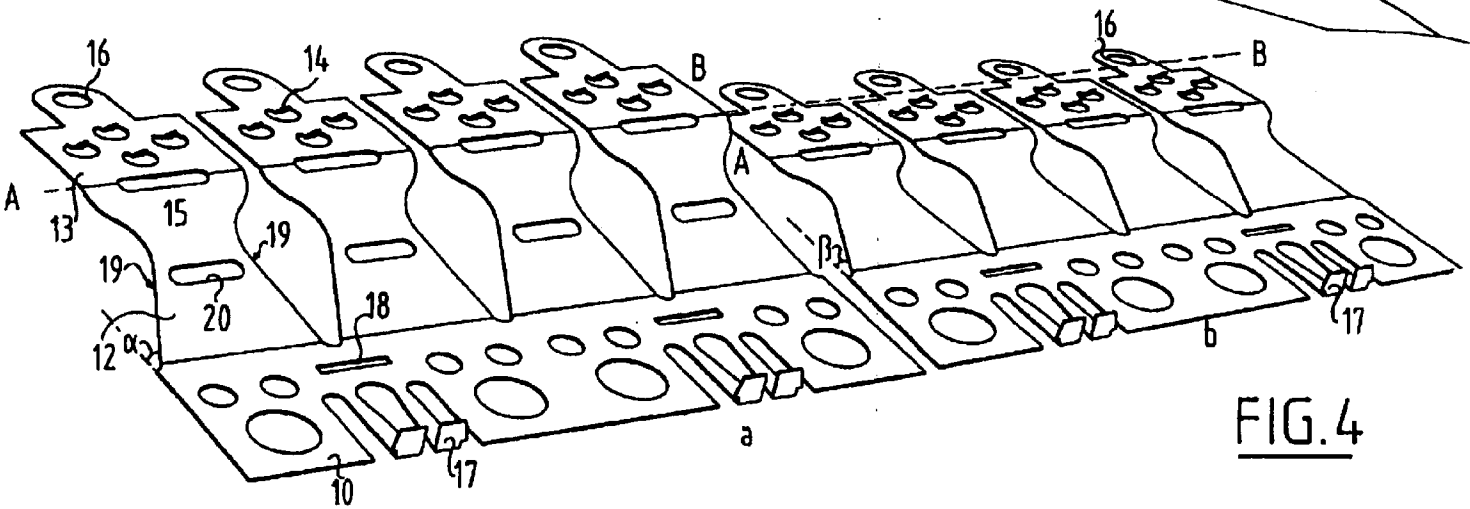
FIG. 4 shows a resilient element according to the invention in a perspective view.

Resilient elements 6 are shown in detail on larger scale in FIGS. 3 and 4, wherein each resilient element consists of a carrier 10, which is strip-like, and strip-like spring leaves 11 directed transversely thereof. The spring leaves consist of a middle part 12 and an end part 13, wherein middle part 12 is bent at the line A—A, so that end part 13 runs practically parallel to strip-like carrier 10.

The end part 13 is provided with attaching members 14 which serve to attach the textile layer 5 thereon.

In the bend transition A—A a space is recessed in the form of an elongate hole 15, the function of which is elucidated below. On the free end remote from opening 15 the end part 13 is provided with a tongue-shaped protrusion 16 which serves for placing in the opening 15 of an adjoining resilient element.

Carrier 10 is embodied with a number of resilient hook-shaped members 17 and a second elongate opening 18 close to the foot of middle part 12.

The middle part 12 is itself recessed along the side edges at 19 in order to gradually decrease the width, i.e. the material cross-section thereof, so that a better resilience is realized.

Carrier 10 is further provided with openings which can be distributed at random to allow a free flow of air.

In FIG. 4 the carrier 10 is provided in each case with four strip-like resilient members 11, although it will be apparent that within the scope of the invention the carriers 10 can be much longer and can contain many more elements.

The mounting of the resilient elements on the roller takes place such that carriers 10 are fixed mutually adjacently on the roller wall in a line parallel to the rotation axis of roller 3. This fixing can take place for instance by means of pop rivets, screws or other suitable fixing means, this such that one row of carriers and strip-like resilient members pointing in a direction opposite to the rotation direction P1 come to lie on the roller 3 along the full length thereof.

The following rows can then be mounted in simple manner by placing the tongue 16 through a hole 15 and then pressing hole 18 over the hook-shaped resilient elements 17 such that they are then snapped fixedly thereon. Thus is created a continuous layer of carriers which are partially overlapping in the roller periphery direction, and a support layer 30 results, see FIG. 3, which consists of the upper surface of the end parts 13 of the resilient element. This support surface 30 serves to support textile layer 5. The textile layer is hooked fixedly on the hook-like pins 14.

In order to realize the overlap at the front and rear end of textile layer 5, an intermediate layer of flatter, and therefore, lower, resilient elements, see FIG. 4, will be initially hooked together, wherein tongues 16 can be severed along the line B—B and the hook-shaped elements 17 can be flattened. For this purpose the carriers can be shifted under the first arranged and fixed carriers of the high elements, wherein the end edge of end parts 13 of the low resilient elements can support on the inclining middle parts 12 of the high elements at the other end thereof. Once fitted, the front end of textile layer 5 can be hooked onto the low elements and then wound round support surface 30 of the high elements. The rear end of textile layer 5 lies freely on the recessed part of the front end thereof, see FIG. 2. It is thus possible to suffice with only one covering layer. Due to the perfect cylindrical surface the covering can be formed from cheap needle felt. The covering suffice to be thin. In this embodiment of a single layer cover, the fabric layer can be provided with indication means, for instance a colored metal line embedded in said fabric, which will be exposed when the layer is abraded. A metal line or thread 52 can be part of an electrical circuit, suitable to generate a warning signal when exposed. Superposed covering layers of different color 50 can also be used. Once a different color is exposed the layer will be replaced.

The invention is not limited to the above described embodiment.

What is claimed is:

1. A device for ironing laundry, which device consists of a heated, semi-cylindrical bed and a roller arranged rotatably therein, the outer periphery of which lies some distance from the bed wall, wherein the roller periphery directed toward the bed is covered with a resiliently yielding layer of textile or fabric, wherein between the roller wall and the layer of textile are arranged resilient elements which are each formed by an elongate carrier with a number of parallel strip-like resilient members directed transversely thereof, and held by the carrier at an angle relative to the roller wall, which carriers are held fixedly in axial direction on the roller wall, wherein the resilient member is engaged with the adjoining resilient member, such that a continuous practically cylindrical support face is obtained.

2. The device as claimed in claim 1, wherein each strip-like member is provided close to the bend with an opening and is embodied on the end part thereof with a tongue-shaped protrusion which in the assembled situation can be received in the opening of the adjoining resilient member.

3. The device as claimed in claim 1, wherein the carrier is provided with attaching members for mutually attaching adjoining carriers in the assembled situation.

4. The device as claimed in claim 1, wherein each strip-like resilient member is bent, the end part of which remote from the carrier extends at a distance from and practically parallel to the roller wall in the assembled situation and is provided with attaching means for the textile layer.

5. The device as claimed in claim 4, wherein the width of the intermediate part of the strip-like resilient member located between carrier and end part is decreased by means of recesses.

6. The device as claimed in claim 1, wherein the carrier is formed by a flat strip, and further including an attaching means comprising openings on one end and a hook-shaped protrusion on the other end, wherein the protrusion is resilient relative to the strip and can be guided in each case into the co-acting opening in the assembled situation.

7. A resilient element suitable for a device as claimed in claim 1, wherein the carrier and the resilient members with associated attaching means are formed integrally from a punched strip of material such that the axially mounted carriers with the resilient members can be assembled as a jacket around the roller.

8. The resilient element as claimed in claim 7, wherein each resilient member has a middle part and adjacent end parts and wherein the angle of inclination $\beta$ of the middle part is smaller than that $\alpha$ of the end parts so as to obtain a lower height between the end part of the resilient member and the roller wall.

9. The resilient element as claimed in claim 8, wherein the width of the strip is variable in order to meet the circumference-length of the drum.

10. A covering layer of fabric material used in an ironing device, consisting of a heated, semi-cylindrical bed and a roller arranged rotatably therein, the outer periphery of which lies some distance from the bed wall, wherein the roller periphery directed toward the bed is covered with a resiliently yielding layer for said covering, and wherein an indication means is embedded in said fabric.

11. The covering layer of fabric material as claimed in claim 10, wherein said indication means is an electrical wire, being part of an alarm circuit.

12. The covering layer of fabric material as claimed in claim 10, wherein said indication means are formed as superposed layers of a different color in said covering.

13. A covering layer of fabric material used in an ironing device, consisting of a heated, semi-cylindrical bed and a roller arranged rotatably therein, the outer periphery of which lies some distance from the bed wall, wherein the roller periphery directed toward the bed is covered with a resiliently yielding layer for said covering, wherein an indication means is embedded in said fabric and wherein said indication means is an electrical wire, being part of an alarm circuit.

* * * * *